United States Patent [19]

McCoy

[11] 4,255,250

[45] Mar. 10, 1981

[54] EXTENDED CYCLE REGENERATIVE REFORMING

[75] Inventor: Charles S. McCoy, Orinda, Calif.

[73] Assignee: Chevron Research Company, San Francisco, Calif.

[21] Appl. No.: 41,967

[22] Filed: May 23, 1979

[51] Int. Cl.[3] ..... C10G 35/04; C10G 35/08

[52] U.S. Cl. ..... 208/64; 208/65; 208/140

[58] Field of Search ..... 208/140, 64, 65

[56] References Cited

U.S. PATENT DOCUMENTS

| | | | |
|---|---|---|---|
| 3,470,090 | 9/1969 | Carson | 208/138 |
| 3,496,096 | 2/1970 | Kluksdahl | 208/140 |
| 3,556,985 | 1/1971 | McCoy | 208/140 |
| 4,069,134 | 1/1978 | Greenwood | 208/64 |

*Primary Examiner*—Curtis R. Davis

*Attorney, Agent, or Firm*—D. A. Newell; M. K. Bosworth; W. L. Stumpf

[57] ABSTRACT

A multiple zone catalytic reforming process in which the $C_5+$ yield or the catalyst run length in all reaction zones downstream of the first is increased by maintaining less than 1 weight percent coke on the catalyst in the first reaction zone by adjusting the frequency of regeneration or replacement.

8 Claims, 3 Drawing Figures

EFFECT OF FRESH CATALYST ABOVE COKED CATALYST

YIELD LOSSES DUE TO COKE AT TOP OF CATALYST BED
10% LAYER, VARIABLE CARBON CONTENT OVER
90% LAYER (13.3% CARBON)

EXTENDED CYCLE REGENERATIVE REFORMING

FIELD OF THE INVENTION

The present invention is directed to the catalytic reforming of hydrocarbon fractions. More specifically, the present invention is concerned with reforming in a plurality of reaction zones in series to improve the octane rating of the feed.

BACKGROUND OF THE INVENTION

Reforming of a naphtha fraction is generally accomplished by passing the naphtha through a plurality of reaction zones in series, each zone containing a catalyst comprising a hydrogenation-dehydrogenation component supported on a porous solid carrier. Typical catalysts include platinum on alumina with or without such promoters such as rhenium, tin, iridium, etc. The naphtha fraction to be reformed is contacted in the first reaction zone with a platinum-containing catalyst at reaction conditions to convert principally naphthenes to aromatics. In addition to naphthene dehydrogenation, side reactions such as isomerization, hydroisomerization and hydrocracking may also occur. Typically, the effluent from the first reaction zone is heated prior to being introduced to a subsequent reaction zone.

After a period of use in reforming, the catalyst becomes gradually deactivated due to the deposition of coke on the surface of the catalyst and consequently a decrease of the octane values of the reformate product is observed.

If the octane requirements imposed upon the particular reforming system are to be continuously met, the reaction temperature of the catalyst must be increased in order to compensate for the loss in activity due to the coke deposition. The fastest catalyst deactivation occurs in the reactor where paraffin dehydrocyclization and hydrocracking are the principal reactions. Consequently, even with a constant inlet temperature, the average reaction temperature increases with each successive reactor because the reactions in each successive reactor are not as endothermic as in the preceding reactor.

Coke deposition on the catalyst not only decreases the activity of the catalyst but also results in a decrease in the yield of $C_5+$ gasoline product produced. Thus, the yield of $C_5+$ gasoline product generally declines throughout the reforming process until it reaches an unacceptable level, at which point common practice is to regenerate all or part of the catalyst. Typical coke levels on the catalyst at the time of regeneration are 10 to 12 weight percent or more on the catalyst in the last reactor and 5 or 6 weight percent on the catalyst in the first reactor. Coke levels on catalysts in intermediate reactors will generally fall between these two figures.

Regeneration procedures, whether continuous or batch operations, are generally well known to the art. Such procedures generally involve several steps: a carbon burn-off by contacting the catalyst with oxygen-containing gas at an elevated temperature until substantially all of the carbon is removed; subsequent contacting of the catalyst with an oxygen-containing gas to redistribute the platinum group metal; a halogen adjustment and optionally a reduction of the regenerated catalyst with a hydrogen-containing gas prior to returning the catalyst to the reactor. See, for instance, U.S. Pat. No. 3,496,096.

SUMMARY OF THE INVENTION

It is an object of this invention to provide a reforming process having an extended operating cycle between regenerations when compared with ordinary reforming processes. It is another object of this invention to provide a method for extending the effective life of a reforming catalyst which is nearing the end of the run.

In accordance with one embodiment of the present invention there is provided for a reforming process wherein a naphtha feedstock is contacted at reforming conditions in the presence of hydrogen with a reforming catalyst in a plurality of reaction zones in series, a product of improved octane rating is recovered from the effluent of the last reaction zone, and during the course of said reforming coke deposits upon said catalyst thereby deactivating and necessitating eventual regeneration or replacement thereof, the method of extending the length of service of the catalyst in all reaction zones downstream of the first which comprises maintaining the level of coke on the catalyst in said first reaction zone at less than 1% by weight of the catalyst by adjusting the frequency at which the catalyst in said first reaction zone is regenerated or replaced with fresh or regenerated catalyst.

In accordance with another embodiment of the present invention, there is provided a multiple stage process for catalytically reforming a naphtha charge stock which comprises:

(a) reacting said charge stock in the presence of catalyst and hydrogen at catalytic reforming conditions in a moving bed reaction zone through which the catalyst is movable via gravity flow and recovering the resulting hydrocarbonaceous effluent from the moving bed reaction zone;

(b) maintaining the amount of coke deposited on the catalyst in said moving bed reaction zone below 1% by weight by at least periodically introducing fresh or regenerated catalyst into the upper end of said moving bed reaction zone and at least periodically withdrawing an equivalent amount of coke-contaminated catalyst from the lower end of said moving bed reaction zone;

(c) further reacting the effluent of said moving bed reaction zone at catalytic reforming conditions in a fixed bed reactor system containing at least one fixed bed reaction zone;

(d) recovering a normally liquid catalytically reformed product from the effluent withdrawn from the last fixed bed reaction zone.

In accordance with yet another embodiment of the present invention, there is provided a catalytic reforming process in which a naphtha fraction is contacted at reforming conditions in the presence of hydrogen with a reforming catalyst in a plurality of reaction zones in series, a product of improved octane rating is recovered from the effluent of the last reaction zone, and during the course of said reforming coke deposits upon said catalyst and deactivates thereby decreasing decreasing the yield of said product, the method of increasing said yield which comprises maintaining the level of coke on the catalyst in said first reaction zone at less than 1% by weight by adjusting the frequency at which the catalyst in said first reaction zone is regenerated or replaced with a fresh or regenerated catalyst.

DETAILED DESCRIPTION

Figure 1:
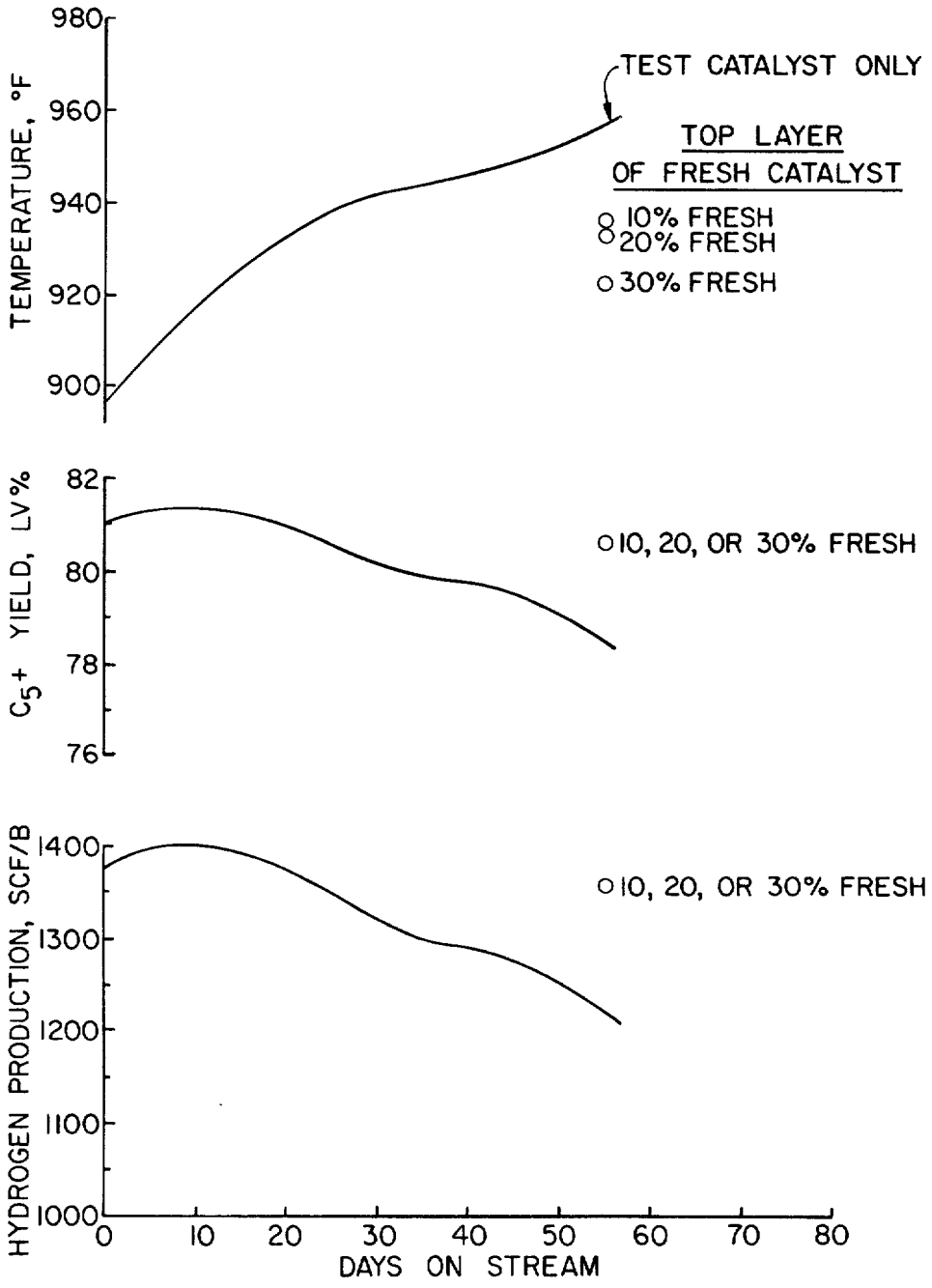
FIG. 1 illustrates the effect on reaction temperature, $C_5+$ yield and hydrogen production of a catalyst bed containing 0, 10, 20 and 30% fresh catalyst on top of a layer of coked catalyst.

The present invention is applicable to those reforming systems wherein a plurality of reation zones in series are used. Preheaters are preferably present between reaction zones so that the temperature of the feed to each reaction zone may be controlled. Preferably, each reaction zone will be located in a separate reactor. The present invention is concerned with those systems wherein at least two reactors and preferably from 3 to 5 reactors are in series. Although some or all of the reactors may be moving bed reactors, the most preferred system is for all reactors to be fixed bed systems or all reactors but the first to be fixed bed systems with the first being a moving bed system.

In multi-reaction zone reforming systems, the catalyst may vary in composition in the different reforming zones, although generally the catalyst is the same in all zones. However, the volume of catalyst generally differs from one reaction zone to the next. A typical catalyst loading in a three-reactor system may employ one-quarter of the total charge of catalyst in the first reactor, one-quarter in the second reactor and one-half in the last reactor. The first reactor generally contains less catalyst because the highly endothermic reaction taking place therein results in the rapid cooling of the feed. If a large volume of catalyst were present in the first reactor, the temperature of the feed in the lower portion of the catalyst bed would be too low for significant dehydrogenation reactions to occur and thus the lower portion of the catalyst bed would not be used effectively.

To achieve the benefits of the present invention, the catalyst in the first reaction zone should be replaced or regenerated with sufficient frequency to maintain a level of coke in the catalyst less than 1% by weight preferably less than 0.7% and still more preferably less than 0.5% by weight. The first reaction zone may contain up to 30% by volume of the total catalyst in the reactor system, although preferably it will contain only up to 20% and still more preferably only up to 15% of the total catalyst mass in the reactor system.

The temperature in each of the reaction zones can be the same or different, but generally it will fall in the range from 700° F. to 1050° F. and preferably within the range of about 850° F. to 1000° F. The terminal reaction zone generally has the highest average catalyst bed temperature. The pressure in each of the reaction zones will usually be the same, either atmospheric or superatmospheric. Preferably, the pressure will be in the range of 25 to 1000 psig and more preferably between 50 and 750 psig. The temperature and pressure can be correlated with the liquid hourly spaced velocity (LHSV) to favor any particularly desirable reforming reactions and will generally be from 0.01 to 10 and preferably from 1 to 5. It is apparent that with different catalyst loading and different reaction zones, the space velocities in the individual reaction zones can vary considerably.

Although reforming generally results in the production of hydrogen, it is common to recycle hydrogen separated from the effluent of any of the reaction zones, usually the terminal reaction zone, to the first or subsequent reaction zones. The hydrogen can be admixed with the feed prior to contacting catalyst or simultaneously with the introduction of the feed to the reaction zone. The presence of hydrogen serves to reduce formation of coke which tends to poison the catalyst. Hydrogen is preferably introduced into the reforming reaction zone at a rate which varies from 0.05 to 20 mols of hydrogen per mol of feed. Hydrogen can be an admixture with light gaseous hydrocarbons.

The catalyst used in the reaction zones comprises a platinum group component in association with a porous solid carrier. Preferably the platinum group component is platinum and the preferred porous solid carrier is a porous refractory in organic oxide, for example, alumina. The platinum group component will be present in an amount of from 0.01 to 3 weight percent and preferably 0.01 to 1 weight percent.

Other components in addition to the platinum group component can be present on the porous solid carrier. It is particularly referred that rhenium be present, for example in an amount of 0.01 to 5 weight percent and more preferably 0.01 to 2 weight percent. Rhenium significantly improves the yields obtained using a platinum-containing catalyst, and a platinum-rhenium catalyst is more fully described in U.S. Pat. No. 3,415,737. Generally, the catalyst will be promoted for reforming by the addition of a halide, particularly fluoride or chloride. The halide provides a limited amount of acidity to the catalyst which is beneficial to most reforming operations. The catalyst promoted with halide preferably contains 0.1 to 3 weight percent total halide content and the preferred halide is chloride.

The catalyst within the first reaction zone may be replaced or regenerated in situ or ex situ, with sufficient frequency to maintain less than 1 weight percent coke on the catalyst, and preferably less than 0.7 weight percent and more preferably, below 0.5 weight percent. The amount of coke on the catalyst should be calculated as the average amount of coke on the entire volume of catalyst in the first reaction zone. The catalyst in the first reaction zone may either be disposed in a fixed or moving bed. If the reaction zone is a fixed bed, it may be radial flow, upflow or downflow, and it may be desirable for a swing reactor to be present and ready to be put in service when the first fixed bed reaction zone is removed from service for regeneration. Of course, if the first reaction zone has a moving catalyst bed, the reaction zone can be maintained onstream while fresh or regenerated catalyst is added to the top of the reaction zone and used coke-deactivated catalyst withdrawn from the bottom. The remaining reaction zones in the system can be either fixed bed or moving bed reaction zones, but for the purposes of this invention, it is advantageous if they are fixed bed reaction zones. The fixed bed reaction zones can be either upflow, downflow or radial flow with radial flow being preferred.

To determine the level of coke or carbon on the catalyst of the first reactor, the catalyst can be sampled as it is removed from the reactor in a moving bed reaction zone or catalyst samples may be withdrawn from the reaction zone itself without disrupting a normal reforming process. A variety of means are available for removing catalyst samples from reactors without involving shutdown of the reactor, for example, see U.S.

Pat. Nos. 3,129,590 and 3,319,469. The level of coke or carbon deposited on the catalyst sample may be determined by any suitable means such as combustion of the carbon and measurement of the quantity of $CO_2$ produced or by determining the rate at which a combustion zone progresses through a bed of coke-contaminated catalyst, such as described in U.S. Pat. No. 3,414,382.

The hydrocarbon feedstock employed in the reforming operation of the present invention may be any suitable hydrocarbon capable of being catalytically reformed at the stated conditions. Preferably the feedstock is a naphtha fraction, which is a light hydrocarbonaceous oil generally boiling within the range from 70° to 550° F and preferably from 150° to 450° F. The feedstock may be, for example, either a straight-run naphtha, a thermally cracked or catalytically cracked naphtha or blends thereof. Generally the naphtha feed will contain from about 25% to 75% and preferably about 35% to 60% paraffins, about 15% to 65% and preferably about 25% to 55% naphthenes and about 5% to 20% aromatics, calculated on a volume percent basis.

Catalyst regeneration procedures are well known to the art and will generally include burning the carbon from the catalyst by contacting the catalyst to an oxygen-containing gas at an elevated temperature from about 700° to 1100° F. Preferably the oxygen concentration and temperature are increased in stages as the regeneration progresses. Following the carbon burn-off, a gaseous halogen may be introduced into contact with the catalyst. Subsequently, the catalyst may be dried and reduced before being returned to the reforming zone. Examples of suitable regeneration processes are illustrated in U.S. Pat. Nos. 3,134,732 and 3,496,096.

EXAMPLES

The present invention will be further clarified by consideration of the following examples which are intended to be purely exemplary and not limiting of this invention. Example 1 shows that the presence of a small amount of fresh catalyst on top of a bed of catalyst containing 10.9% carbon acts to substantially increase the $C_5$+ yield and hydrogen production as well as to decrease the average catalyst temperature required to make a product of a predetermined octane. These results indicate that the presence of a small amount of fresh catalyst upstream of a larger mass of coke-contaminated catalyst serves to significantly extend the length of time which the total mass of catalyst can be maintained in reforming service before being regenerated. Example 2 shows the adverse effect on yield due to the presence of an increasing amount of coke on a small mass of catalyst situated above a larger mass of coke deactivated catalyst. These results indicate that the less carbon that is present on the catalyst in the first reaction zone, the better the overall yield. Example 3 is a side-by-side comparison of reforming with a catalyst bed containing 10% fresh catalyst on top of a bed of test catalyst containing various levels of coke which illustrates the activity and yield advantages of having a small layer of fresh catalyst present in the top of the catalyst bed.

EXAMPLE 1

A mid-continent naphtha having the characteristics shown in Table I was passed through a series of foul reactors containing a platinum-rhenium reforming catalyst at reforming conditions including a pressure of 200 psig, a liquid hourly space velocity of 2, a hydrogen to hydroccarbon mol ratio of 3 and a temperature adjusted to obtain a reformate product having a research octane number of 98 clear.

TABLE I

| Mid-Continent Naphtha | |
|---|---|
| Gravity °API | 55.0 |
| D-86 Distillation | |
| IBP- °F. | 174 |
| 10% - °F. | 214 |
| 30% - °F. | 239 |
| 50% - °F. | 263 |
| 70% - °F. | 294 |
| 90% - °F. | 342 |
| EP - °F. | 390 |
| % Paraffins | 43.1 |
| % Naphthenes | 46.8 |
| % Aromatics | 10.0 |

After 55 days onstream, a portion of the catalyst was removed from the last reactor in the series. The catalyst, averaging 10.9 weight percent coke, was tested in a micro-sized pilot plant reformer in three separate tests in which the top 10%, 20% and 30% of the used catalyst replaced by an equivalent amount of fresh catalyst. The results, as represented in FIG. 1 and Table II show that by placing a layer of fresh catalyst on top of a larger mass of coked catalyst, (1) the activity of the total mass of catalyst increased significantly, by 19° F. for 10% fresh catalyst, by 22° F. for 20% fresh catalyst, and by 32° F. for 30% fresh catalyst; (2) the $C_5$+ yield increased by 1.9 liquid volume percent, from approximately 78.6 to 80.5 LV percent; (3) the hydrogen production increased by about 11%, from 1217 standard cubic feet per barrel of feed to 1356–1347 standard cubic feet per barrel of feed; and (4) $CH_4$ production decreased 23–26%, from 108 standard cubic feet per barrel of feed to 80–83 standard cubic feet per barrel of feed. Thus, the presence of a small amount of fresh catalyst on top of a larger amount of coked catalyst serves to substantially increase the activity, $C_5$+ liquid yield and rate of hydrogen production, far more than would be predicted just from the small amount of fresh catalyst added.

TABLE II

| Layered-Bed Tests on End-of-Run Catalyst | $T_o$, °F. | $C_5$+, LV % | $H_2$, SCF/B | $CH_4$, SCF/B |
|---|---|---|---|---|
| End-of-Run (EOR) Catalyst, 10.9% C, | 955 | 78.6 | 1217 | 108 |
| 10% Fresh over 90% EOR Catalyst | 936 | 80.6 | 1356 | 82 |
| 20% Fresh over 80% EOR Catalyst | 933 | 80.5 | 1347 | 80 |
| 30% Fresh over 70% EOR Catalyst | 923 | 80.5 | 1349 | 83 |

EXAMPLE 2

Figure 2:
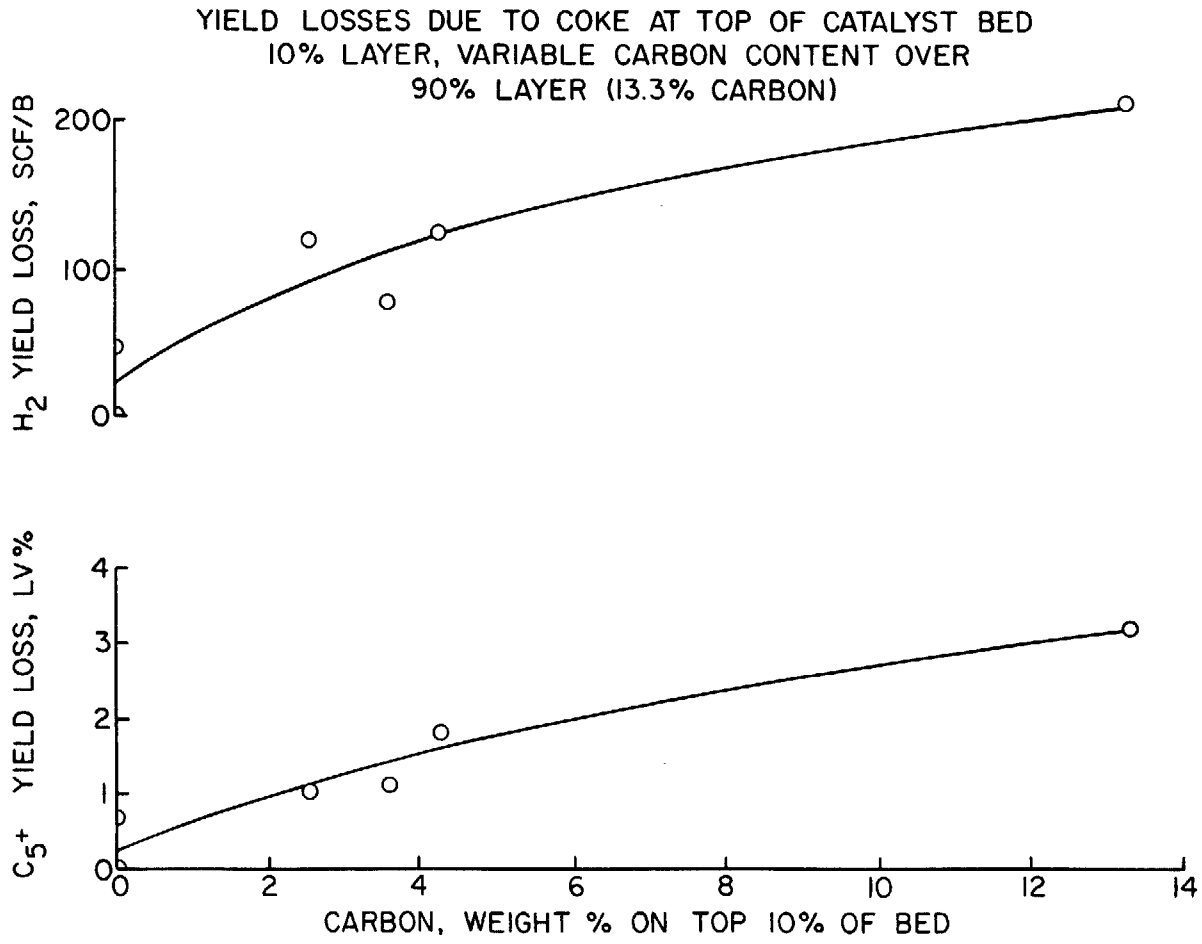
FIG. 2 illustrates yield losses due to variable levels of coke on catalyst at the top of a bed of coked catalyst.
Figure 3:
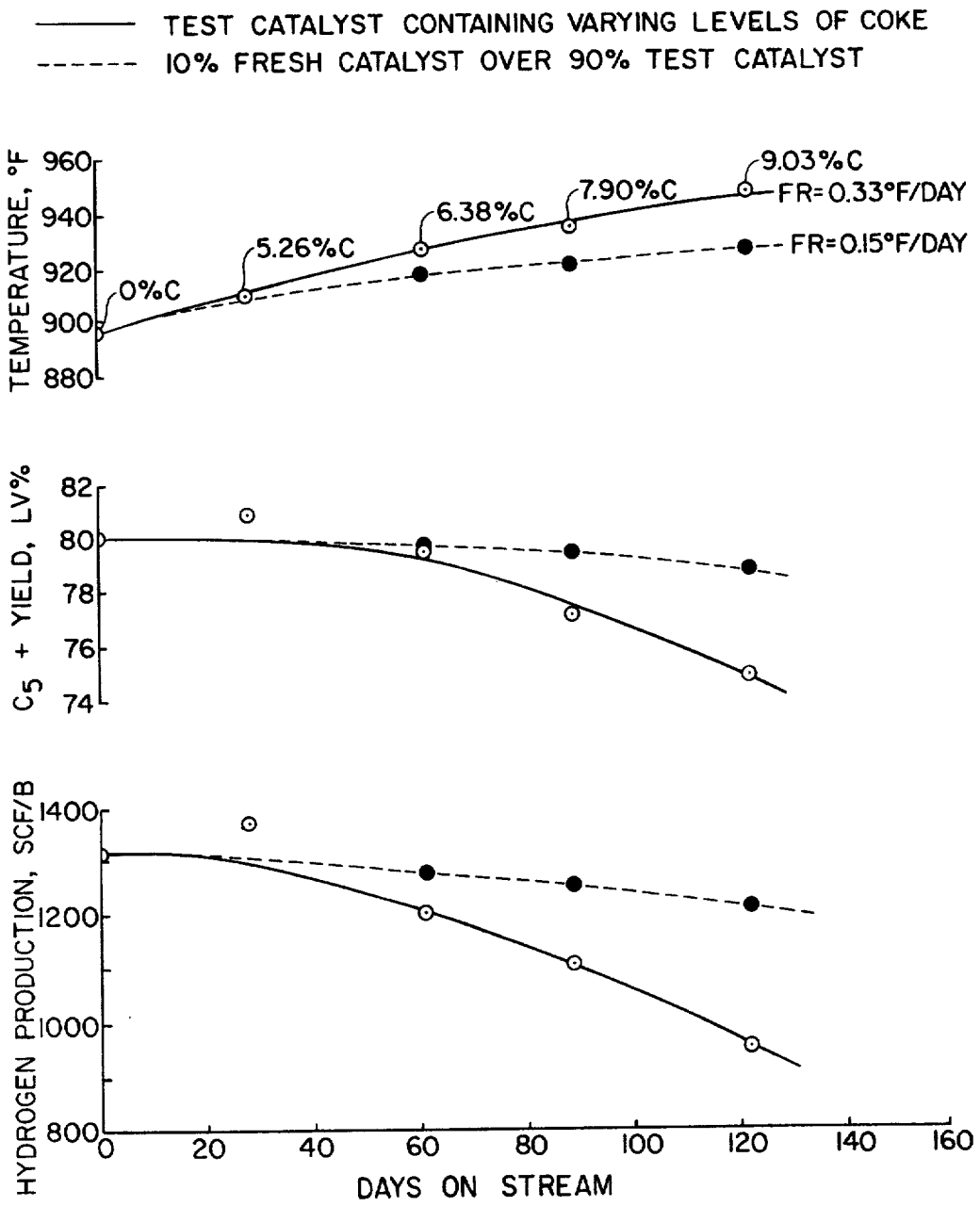
FIG. 3 illustrates the results of a comparison between reforming with coked catalyst and with 10% fresh catalyst on top of coked catalyst.

A study was made to determine the effect on yield of a varying amount of coke on the top 10% of catalyst in a catalyst bed. FIG. 2 shows the effect on $C_5$+ yield and $H_2$ yield associated with an increasing carbon content on the catalyst in the top 10% of the catalyst bed. Using as the standard a catalyst bed containing 10% fresh catalyst on top of 90% catalyst containing 13.3 weight percent carbon, a catalyst bed with the top 10% of catalyst containing 2 weight percent carbon loses 1% by volume of $C_5$+ yield; a catalyst bed with the top 10% of catalyst containing about 6 weight percent carbon loses 2% by volume of $C_5+$ yield; and a catalyst bed with the top 10% of catalyst containing about 12 weight percent carbon loses about 3% by volume of $C_5+$ yield. Hydrogen yield loss also increases in the same manner with increasing carbon content in top 10% of the catalyst in the catalyst bed. Thus, to obtain the maximum yield benefit from the process of this invention, the amount of carbon on the catalyst in the top of the catalyst bed should be kept as low as possible.

EXAMPLE 3

A test was conducted to compare the performance of a bed of coke-deactivated platinum-rhenium catalyst with an equivalent volume of catalyst comprising 10 volume % fresh catalyst on top of 90% of the deactivated catalyst. Samples of catalyst from a commercial reformer were obtained at approximately 0, 28, 61, 89 and 122 days on stream. One portion of each catalyst sample was tested on the feedstock shown in Table I at reforming conditions including a pressure of 200 psig, a liquid hourly spaced velocity of 2, a hydrogen to hydrocarbon mol ratio of 3 and a temperature adjusted to obtain a reformate product having a research octane number of 98, clear. A layer of 10% fresh catalyst was put on top of a 90% layer of catalyst from 61, 89 and 122-day samples, respectively, and then rested under the same reforming conditions.

The results, as shown in FIG. III, demonstrate that the catalyst beds containing 10% fresh catalyst are far more active (20° F. after 120 hours) and more selective (4% $C_5+$ yield after 120 hours) than the beds containing only coked catalyst. The fouling rate for the beds containing 10% fresh catalyst is less than that for the beds of coked catalyst—0.15° F./day vs. 0.33° F./day, indicating that the effect of the fresh catalyst is far out of proportion to its volumetric presence.

From the foregoing, it may be seen that the present invention operates in a novel and effective manner to increase the activity, selectivity ($C_5+$ yield) or both of the total mass of catalyst in a reforming reaction zone, and thus it permits the service life of the bulk of catalyst to be extended before regeneration or replacement is necessary.

Although only specific arrangements and modes of operation of the present invention have been described, numerous changes can be made in those arrangements without departing from the spirit of the invention and also changes that fall within the scope of the appended claims are intended to be embraced thereby.

What is claimed is:

1. In a reforming process wherein a naphtha feedstock is contacted at reforming conditions in the presence of hydrogen with a reforming catalyst in a plurality of reaction zones in series, a product of improved octane rating is recovered from the effluent of the last reaction zone, and during the course of said reforming coke deposits upon said catalyst thereby deactivating said catalyst and necessitating eventual regeneration or replacement thereof, the method of extending the length of service of the catalyst in all reaction zones downstream of the first which comprises maintaining the level of coke on the catalyst in said first reaction zone at less than 1% by weight by adjusting the frequency at which the catalyst in said first reaction zone is regenerated or replaced with fresh or regenerated catalyst.

2. The process of claim 1 wherein said first reaction zne contains not more than 30% by volume of the total mass of catalyst in said plurality of reaction zones.

3. The process of claim 1 wherein said first reaction zone comprises a moving bed of catalyst and at least periodically a portion of coke-contaminated catalyst is withdrawn from a lower portion of said moving bed, regenerated, and returned to the upper portion of said moving bed.

4. A multiple stage process for catalytically reforming a naphtha charge stock in a plurality of reaction zones in series which comprises:

(a) reacting said charge stock in the presence of catalyst and hydrogen at catalytic reforming conditions in a moving bed reaction zone through which said catalyst is movable via gravity flow and recovering the resulting hydrocarbonaceous effluent from said moving bed reaction zone;

(b) maintaining the amount of coke deposited on the catalyst in said moving bed reaction zone below 1% by weight by at least periodically introducing fresh or regenerated catalyst into the upper end of said moving bed reaction zone and at least periodically withdrawing an equivalent amount of coke-contaminated catalyst from the lower end of said moving bed reaction zone;

(c) further reacting said effluent of said moving bed reaction zone at catalytic reforming conditions in a fixed bed reactor system containing at least one fixed bed reaction zone;

(d) recovering a normally liquid catalytically reformed product from the effluent withdrawn from the last fixed bed reaction zone.

5. The process of claim 4 wherein said coke-contaminated catalyst withdrawn from said moving bed reaction zone is regenerated and returned to the top of said moving bed reaction zone as said regenerated catalyst.

6. The process of claim 4 wherein said first reaction zone contains less than 30% by volume of the total catalyst in said reaction zones.

7. In a reforming process wherein a naphtha feedstock is contacted at reforming conditions in the presence of hydrogen with a reforming catalyst in a plurality of reaction zones in series, a product of improved octane rating is recovered from the effluent of the last reaction zone, and during the course of said reforming coke deposits upon and said catalyst deactivates thereby decreasing the yield of said product, the method of increasing said yield which comprises maintaining the level of coke on the catalyst in said first reaction zone at less than 1% by weight by adjusting the frequency at which the catalyst in said first reaction zone is regenerated or replaced with a fresh or regenerated catalyst.

8. The process of claims 1, 4 or 7 wherein said catalyst comprises an alumina support having disposed thereon in intimate admixture 0.01 to 3 weight percent platinum and 0.01 to 5 weight percent rhenium.

* * * * *